US011866080B2

(12) United States Patent
Green et al.

(10) Patent No.: US 11,866,080 B2
(45) Date of Patent: Jan. 9, 2024

(54) SIGNAL ASPECT ENFORCEMENT

(71) Applicant: THALES CANADA INC., Toronto (CA)

(72) Inventors: Alon Green, Toronto (CA); Walter Kinio, Toronto (CA)

(73) Assignee: THALES CANADA INC, Ontario (CA)

( * ) Notice: Subject to any disclaimer, the term of this patent is extended or adjusted under 35 U.S.C. 154(b) by 444 days.

(21) Appl. No.: 17/073,145

(22) Filed: Oct. 16, 2020

(65) Prior Publication Data

US 2021/0114634 A1 Apr. 22, 2021

Related U.S. Application Data

(60) Provisional application No. 62/916,672, filed on Oct. 17, 2019.

(51) Int. Cl.

*B61L 3/02* (2006.01)
*B61L 3/00* (2006.01)

(Continued)

(52) U.S. Cl.

CPC ..... *B61L 3/02* (2013.01); *B61L 3/008* (2013.01); *B61L 3/125* (2013.01); *B61L 9/00* (2013.01); *B61L 15/0027* (2013.01); *B61L 25/021* (2013.01); *B61L 25/025* (2013.01); *B61L 23/041* (2013.01); *B61L 2201/00* (2013.01);

(Continued)

(58) Field of Classification Search

CPC .. B61L 3/02; B61L 3/008; B61L 3/125; B61L 9/00; B61L 15/0027; B61L 23/041; B61L 25/021; B61L 25/025; B61L 2201/00; B61L 2205/00; B61L 2207/00

See application file for complete search history.

(56) References Cited

U.S. PATENT DOCUMENTS 5,249,157 A 9/1993 Taylor
5,340,062 A 8/1994 Heggestad (Continued)

FOREIGN PATENT DOCUMENTS

CA 2101892 A1 2/1994
WO 2007091072 A1 8/2007
WO 2009035751 A1 3/2009

OTHER PUBLICATIONS

Fabian De Ponte Muller, Survey on Ranging Sensors and Cooperative Techniques for Relative Positioning of Vehicles, Sensors journal vol. 17(2): 271, Jan. 30, 2017, MDPI, Basel, Switzerland.

(Continued)

*Primary Examiner* — Zachary L Kuhfuss
(74) *Attorney, Agent, or Firm* — Hauptman Ham, LLP

(57) ABSTRACT

A signal aspect enforcement method for a rail vehicle includes determining if vehicle position is unknown. The system determines if rail vehicle speed is less than a line-of-sight threshold speed. The system determines the grade of the rail. A worst-case braking distance of rail vehicle is calculated. The signal aspect is determined using a camera system and a beacon system. The system determines if the signal aspect determined by camera system is same as signal aspect determined by beacon system and, if so, determines the route of rail vehicle and speed limit of rail vehicle.

20 Claims, 12 Drawing Sheets

(51) Int. Cl.

| | |
|---|---|
| ***B61L 9/00*** | (2006.01) |
| ***B61L 15/00*** | (2006.01) |
| ***B61L 25/02*** | (2006.01) |
| ***B61L 3/12*** | (2006.01) |
| *B61L 23/04* | (2006.01) |

(52) U.S. Cl.
CPC ..... *B61L 2205/00* (2013.01); *B61L 2207/00* (2013.01)

(56) References Cited

U.S. PATENT DOCUMENTS

| | | | |
|---|---|---|---|
| 5,828,979 | A | 10/1998 | Polivka et al. |
| 5,978,718 | A | 11/1999 | Kull |
| 6,957,131 | B2 | 10/2005 | Kane et al. |
| 7,254,467 | B2 | 8/2007 | Fries et al. |
| 8,296,065 | B2 | 10/2012 | Haynie et al. |
| 8,812,227 | B2 | 8/2014 | Carlson et al. |
| 9,221,481 | B2 | 12/2015 | Desbordes et al. |
| 9,434,397 | B2 | 9/2016 | Chung et al. |
| 9,663,127 | B2 | 5/2017 | Palmer et al. |
| 9,731,738 | B2 | 8/2017 | Carlson et al. |
| 10,081,376 | B2 | 9/2018 | Singh |
| 10,275,664 | B2 | 4/2019 | Mullen |
| 10,328,922 | B2 | 6/2019 | Kumar et al. |
| 2010/0063657 | A1 | 3/2010 | Kumar |
| 2010/0332058 | A1 | 12/2010 | Kane et al. |
| 2014/0100724 | A1 | 4/2014 | Ghaly |
| 2014/0218482 | A1 | 8/2014 | Prince |
| 2015/0005993 | A1* | 1/2015 | Breuing ..... G01S 13/60 701/19 |
| 2016/0121912 | A1* | 5/2016 | Puttagunta ..... B61L 25/025 701/19 |
| 2016/0185291 | A1 | 6/2016 | Chamberlin |
| 2018/0093683 | A1 | 4/2018 | Garrido et al. |
| 2019/0054942 | A1 | 2/2019 | Carlson |
| 2019/0232989 | A1 | 8/2019 | Hogan et al. |
| 2019/0248392 | A1 | 8/2019 | Bar-Tal et al. |
| 2019/0256115 | A1 | 8/2019 | Kranz |
| 2020/0172132 | A1* | 6/2020 | Kernwein ..... B61L 27/20 |

OTHER PUBLICATIONS

Najmedin Meshkati, A Study of the Exposition Light-Rail's Safety for Pedestrians and Drivers, METRANS, May 13, 2007, METRANS, Southern California, U.S.

Alan Rumsey et al., An Assessment of the Business Case for Communications-Based Train Control, FTA Report No. 0045, Sep. 2013, Delcan Corporation.

International Search Report and Written Opinion issued in corresponding International Application No. PCT/IB2020/059780, dated Jan. 12, 2021, pp. 1-10, Canadian Intellectual Property Office, Quebec, Canada.

Partial Supplementary European Search Report issued in corresponding European Application No. 20877536.1, dated Nov. 6, 2023, pp. 1-17.

* cited by examiner

SIGNAL ASPECT ENFORCEMENT

PRIORITY CLAIM

The present application claims the priority of U.S. Provisional Application No. 62/916,672, filed Oct. 17, 2019, which is incorporated herein by reference in its entirety.

BACKGROUND

Safe and efficient train operation relies on the consistent transmission and receipt of signals that provide instructions to train drivers or train control systems. When a vehicle is able to communicate with a wayside/central movement authority unit (MAU), a current movement authority is communicated to the vehicle and the vehicle is allowed to proceed to the limit of the received movement authority, under the speed restrictions specified in the movement authority.

For communication-based train control (CBTC) operation, signal enforcement is only possible when communicating with a train having an established position. A wayside MAU sends an appropriate movement authority to the train, based on the reported status of a signal aspect. In certain failure situations, such as if the vehicle position is not determined or the communication with the MAU is not functioning, the CBTC on-board (on-board the vehicle) controller commands the vehicle to brake to a stop because the movement authority is not able to be determined.

When the vehicle is operating unattended and encounters a failure situation, the vehicle is forced to stop and a special recovery procedure, typically involving sending crew to the failed vehicle, is necessary to continue operation. This process results in service delays and passenger dissatisfaction.

DETAILED DESCRIPTION

Figure 1A:
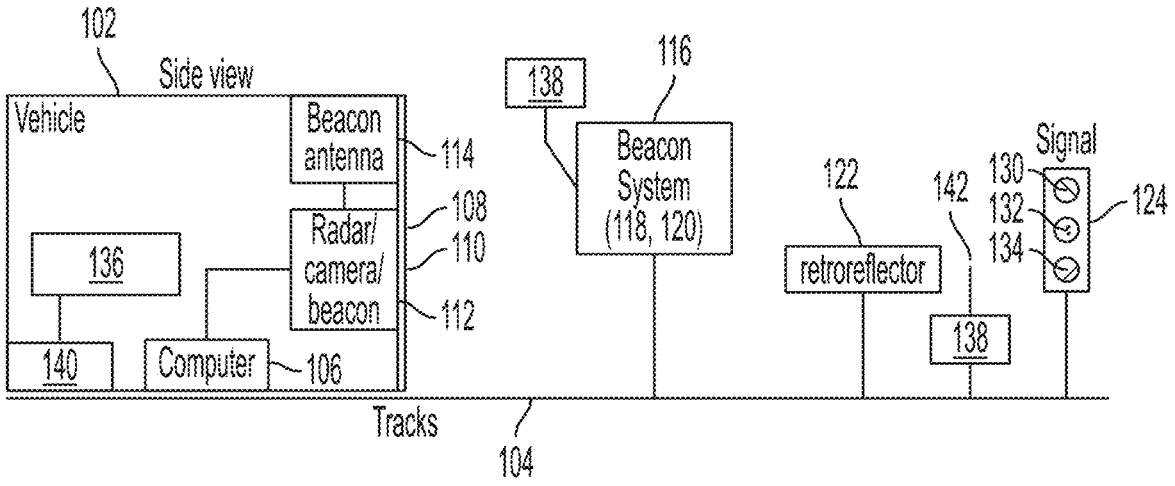
FIGS. 1A and 1B are diagrams including a side view and top view of a signal enforcement system architecture, in accordance with some embodiments.

The following disclosure provides many different embodiments, or examples, for implementing different features of the provided subject matter. Specific examples of components, values, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 1B:
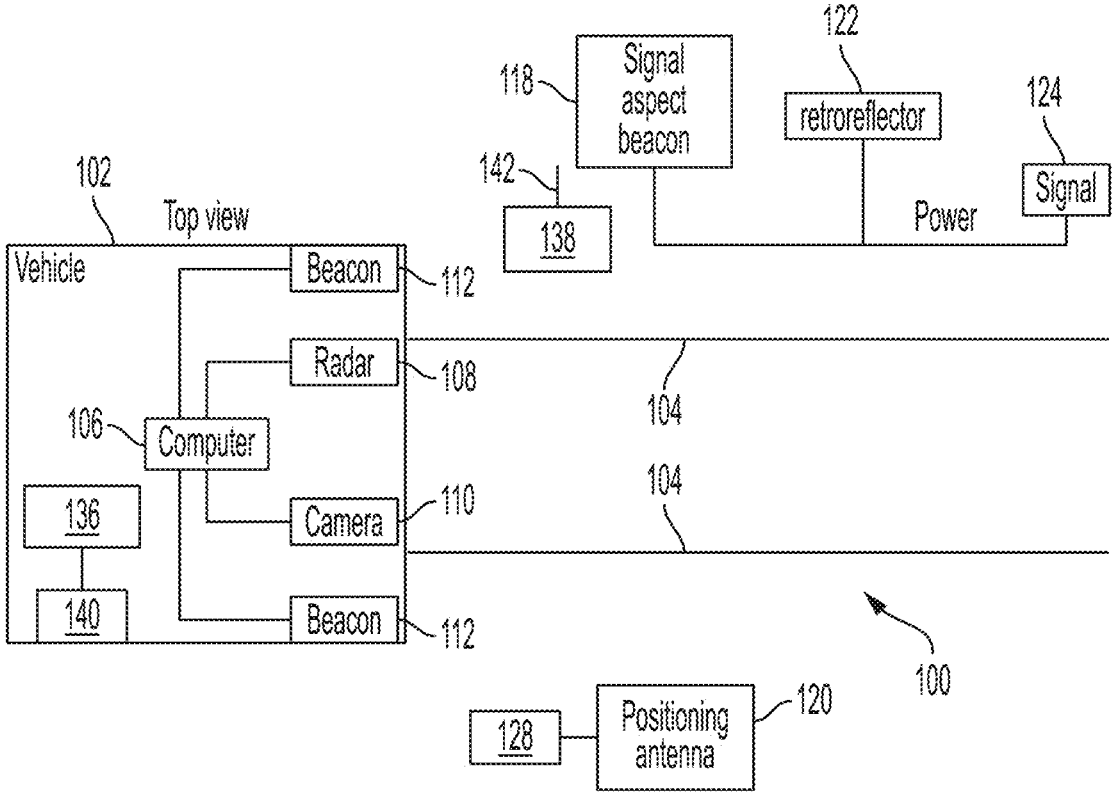

FIGS. 1A and 1B are side view and top view diagrams of a signal aspect enforcement system architecture, in accordance with some embodiments. A vehicle 102 moves along tracks 104. The vehicle 102, in accordance with some embodiments, is a train, subway, monorail, car, bus or other suitable vehicle. The tracks 104, in accordance with some embodiments, are train tracks, rails, roads or other vehicle guideways. On board the vehicle 102 is a computer 106, also referred to as a vehicle on-board controller (VOBC). In at least some embodiments, computer 106 is an on-board controller (also referred to as an on-board computer), processor, processing device or the like. The on-board computer 106 is communicably connected to and communicates with a radar 108, a camera 110 and one or more on-board beacons 112. The camera 110, in accordance with some embodiments, includes one or more visible spectrum, near infra-red (IR) spectrum, long wavelength infra-red spectrum or other wavelength suitable cameras. The beacon system 112, in accordance with some embodiments, includes one or more of an ultra-wide band, dedicated short range communications, radio frequency identification or another internet-of-things system or other suitable beacon system capable of providing signal aspect status, beacon identification (ID) and/or ranging information to the vehicle 102. The on-board beacons 112 (FIG. 1B) are communicably connected to a beacon antenna 114.

Alongside the tracks 104 is a beacon system 116, including a signal aspect beacon 118 and a positioning beacon 120. The signal aspect beacon 118 associated with signal 124 is installed a predetermined distance before the signal 124 to increase the on-board beacon detection range. A retroreflector 122 and a signal 124 are electrically connected to the signal aspect beacon 118. In accordance with an embodiment, retroreflector 122 and signal aspect beacon 118 receive power from the signal aspect of signal 124. In accordance with various embodiments, retroreflector 122, signal 124, MAU 128 and signal aspect beacon 118 are connected to individual power sources (not shown). A MAU 128 is communicably connected with the beacon system 116, in particular with the positioning beacon 120 and signal aspect beacon 118 and communicates movement authority data to the vehicle 102. In some embodiments, retroreflector 122 is an active retroreflector.

Signal 124 has three signal aspects: a green signal aspect 130 which indicates that the vehicle 102 is able to proceed normally, a yellow signal aspect 132 which indicates that the vehicle 102 is able to proceed with cautionary speed restrictions and a red signal aspect 134 which indicates that the vehicle 102 must stop. When a signal aspect is to be enforced, the signal aspect is illuminated or "lit." When a signal aspect is not to be enforced, the signal aspect is not illuminated or "dark."

The signal aspect enforcement system and method, in accordance with an embodiment, uses on-board visible spectrum, near infra-red spectrum and/or long-wavelength infra-red camera 110, beacon system 112 and on-board radar 108 with the associated active retroreflector 122 to determine the signal aspect and the associated movement authority past the signal 124. The beacon system 116 consists of an on-board beacon requester 112 and a beacon responder 118 associated with the signal 124. The radar 108, in accordance with an embodiment, is a commercial, off-the-shelf radar such as a 77 GHz millimeter (mm) wavelength radar, which is capable of providing range, azimuth and a measure of the strength of the reflection for detected targets. In accordance with an embodiment, a 3D radar is used to provide the relative elevation of the returns.

The on-board computer 106 contains a database with all the signals 124 in the system along with the corresponding signal location, ID, associated beacon IDs, signal aspects (including the aspect colors and aspect location in the signal structure) and restrictions associated with each aspect. In at least one embodiment, the signal location is provided with respect to a guideway map. The guideway map includes both the gradient and curvature of the track 104 well as the location of signals 124 relative to the adjacent track 104. The guideway map includes the line-of-sight (LOS) range at any given location on the track 104. The LOS range is the furthest distance along the tracks that is not obstructed (by tunnel walls or other structures.

Sensors such as cameras, radars and beacons typically are limited to being able to detect objects or features within their LOS. Objects or features beyond the LOS are not "visible" to these sensors, except in certain multipath conditions in which the measurements are not trustable.

The on-board computer 106 calculates the braking distance required to bring the vehicle 102 to a complete stop in consideration of the grade and the guaranteed emergency brake rate (GEBR), due to the grade of the track 104, failures in the braking system and latencies in the braking system. Even though the position is not determined, the grade is estimated by differentiating the motion acceleration calculated based on the speed measurements and the measured acceleration using Equation (1).

$$\text{Grade}=(V_{Measured}t_i-V_{Measured}t_{i-1})/(t_i-t_{i-1})-a_{Measured} \quad \text{Equation (1):}$$

where $V_{Measured}\ t_i$ is the measured speed at time $t_i$;
$V_{Measured}\ t_{i-1}$ is the measured speed at time $t_{i-1}$; and
$a_{Measured}$ is the average acceleration of the measured accelerations at times $t_i$ and $t_{i-1}$.

The on-board computer 106 determines the maximum worst case braking distance of the vehicle using Equation (2). This determination considers the propulsion runaway acceleration, the propulsion cutoff time, the emergency brake engagement time and the GEBR.

$$d_{EB}=V_{LOS}\times t_{PCO}+0.5(a_{PRW}+\text{Grade})\times t_{PCO}^2+(\text{VLOS}+(a_{PRW}+\text{Grade})\times t_{PCO})\times t_{EBE}+0.5\text{Grade}\times t_{EBE}^2+(V_{LOS}+(a_{PRW}+\text{Grade})\times t_{PCO}+\text{Grade}\times t_{EBE})^2/(2\times(\text{GEBR}+\text{Grade}) \quad \text{Equation (2):}$$

where $d_{EB}$ is the worst case braking distance;
$V_{LOS}$ is the LOS speed;
$t_{PCO}$ is the propulsion cutoff time;
$a_{PRW}$ is the propulsion runaway acceleration; and
$t_{EBE}$ is the emergency brake engagement time.

The signal 124, signal ID, and associated aspect are determined based on multiple sensors. For example, in accordance with an embodiment, the sensors include a visible spectrum, near IR spectrum and/or LWIR camera 110 and/or a beacon system 112 and/or radar 108.

When the vehicle's position on the guideway is known, the on-board computer 106 determines that the signal aspect is red 134 if a retroreflector 122 associated with the red aspect 134 of the signal 124 are detected in their expected location as in the map and the along-tracks distance to the signal 124. Verifying the location of the retroreflector prevents false positives.

The on-board computer 106 determines the signal aspect based on data provided by independent sensors such as camera 110, beacon system 112, radar 108 and retroreflector 122. Two sensors, for example, the camera 110 and beacon system 112, are sufficient to provide the information necessary to determine the signal ID and the vehicle position on the guideway from which the along-tracks distance to the signal is derived. To determine the signal aspect and the along-tracks distance to the signal based on the radar 108 and the associated retroreflector 122, the vehicle position is provided to the on-board computer 106.

When the vehicle 102 position on the guideway is unknown or the vehicle 102 is not able to communicate with the MAU 128, the camera 110 records image data representing the guideway, on-board computer 106 determines the signal ID and the aspect of the signal 124 using object and color recognition algorithms processing image data representing a view of the guideway received from the camera 110. The on-board computer 106 compares the signal ID and aspect information determined from the image data with the signal ID and aspect information received from the signal aspect beacon 118 to determine a match. Matching establishes confidence in the signal ID and aspect determined from image data generated by the camera 110. When the vehicle 102 position on the guideway is unknown or the vehicle 102 is not able to communicate with the MAU 128, the on-board computer 106 uses image and color recognition algorithms to identify "dark" signal aspects in the image data from the camera 110. A signal aspect is "dark" when the associated signal is not illuminated. When the vehicle 102 position on the guideway is unknown or the vehicle 102 is not able to communicate with the MAU 128, the on-board computer determines whether the vehicle 102 is authorized to proceed along the route and what speed limit the vehicle 102 must respect based on the signal ID and the signal aspect. For example, if the signal 124 aspect is red, the vehicle 102 is not be allowed to proceed along the route and is directed to stop. If the signal 124 aspect is green, the vehicle 102 is allowed to proceed along the route, respecting the speed limit associated with a green signal. When the vehicle 102 position on the guideway is unknown or the vehicle 102 is not able to communicate with the MAU 128, the on-board computer 106 determines the vehicle position from the along-tracks distance determined by the radar 108. The on-board computer 106 determines if the vehicle 102 has sufficient distance to come to a stop before reaching a signal 124 and sends a signal to the vehicle emergency brakes (not shown) if the signal aspect is red 134 and the vehicle 102 does not have a sufficient distance to come to a stop before reaching the signal 124.

The beacon system 112 allows the vehicle 102 to determine the signal ID and signal aspect, and to reestablish the position of the vehicle 102 on the guideway with the detection of at least two wayside beacons 116. By establishing the position of the vehicle on the guideway and the signal aspect, the on-board computer 106 establishes the route the vehicle 102 is authorized to take and the speed limit of the vehicle. The speed limit is determined by the on-board computer using the speed limit associated with signal aspect and the speed limit associated with the vehicle's position on the guideway from the guideway map.

The on-board computer 106 determines if the signal aspect is commanded on and if the signal 124 is actually "lit" based on signal data received by on-board beacon 112. The on-board beacon 112 receives signal data from a signal aspect beacon 118 associated with the signal 124. The on-board computer uses the signal data received from the signal aspect beacon 118 associated with the signal 124 to determine if a "dark" signal aspect reported by camera 110 is valid.

A communication system such as WiFi and/or LTE and/or bluetooth and/or UWB is used to determine the signal ID and aspect via communication message from a wayside radio 138 to the on-board radio 136. The wayside radio antenna 142 (or antenna array) location on the guideway is in the database map. In at least some embodiments, the wayside radio is a dedicated radio associated with the signal. In at least some embodiments, the wayside radio is a generic radio for communicating different types of information.

The range between the on-board radio antenna 140 and the wayside radio antenna 142 (or antenna array) is measured using range estimation based on the signal-to-noise ratio range measurement techniques (e.g., RSSI). The signal-to-noise ratio range values behave according to a Poisson distribution as a function of the range between these two devices. In accordance with another embodiment, range is measured using range estimation based on time-of-flight range measurement techniques (e.g., FM RTT). In accordance with another embodiment, the range is measured using angle of arrival and/or angle of departure estimation based on a MIMO (multiple Input Multiple Output) antenna array.

In at least some embodiments, Wi-Fi, LTE, Bluetooth or UWB communication systems typically operate within the 2.4 GHz to 10 GHz base frequency band.

Figure 4:
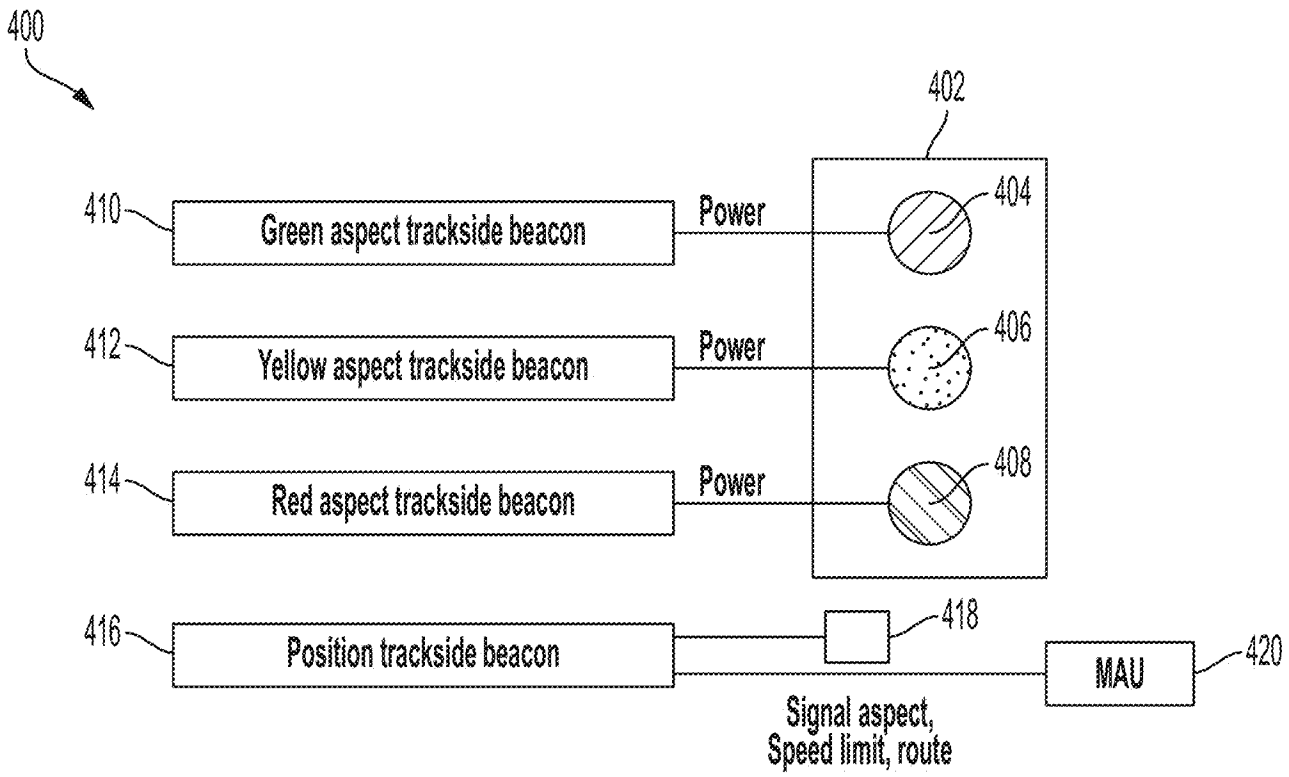
FIG. 4 is a diagram of a signal and trackside beacon arrangement, in accordance with some embodiments.

FIG. 4 is a diagram 400 of a signal and trackside beacon arrangement, in accordance with some embodiments. A signal 402, similar to signal 124 in FIG. 1, includes three signal aspects; a green aspect 404, a yellow aspect 406 and a red aspect 408. The green aspect 404 is electrically connected to and sends power to a green aspect trackside beacon 410. The yellow aspect 406 is electrically connected to and sends power to a yellow aspect trackside beacon 412. The red aspect 408 is electrically connected to and sends power to a red aspect trackside beacon 414. A MAU 420 is communicably connected with a position trackside beacon 416, similar to positioning beacon 120 in FIG. 1B. The MAU 420 sends signals corresponding to the signal aspect, speed limit and route to the position trackside beacon 416. The position trackside beacon 416 is connected to a power source 418.

The Movement Authority Unit (MAU) calculates the movement authority to each train based on the train position, switch status, signal aspect, or the like. The MAU is located at the central control room or at stations rooms. It is a wayside central control unit. The MAU receives the location of each train, the switches status, routes status, signals aspects status, etc. and determine the movement authority for each train.

Signal aspect beacon 118 receives power from an associated aspect (e.g., red aspect 134) of a signal 124. Positioning beacon 120 does not receive power from an associated aspect but is in communication with MAU 128, receiving signal aspect information and relaying the signal ID and aspect information to the on-board beacon 112. If the signal aspect is red, for example, the on-board beacon 112 receives the signal data from the positioning beacon 120 and the signal aspect beacon 118 and the on-board computer 106 uses the signal data to establish the position of the vehicle 102 and determine the signal aspect. If two positioning beacons 120 are used, the position is reestablished and the signal aspect is determined. If the signal aspect is not red, then signal aspect beacon 118 is not powered and therefore is not detected by the on-board beacon 112. However, if the signal aspect is red, then signal aspect beacon 118 is powered and therefore is detected by the on-board beacon 112

Figure 2:
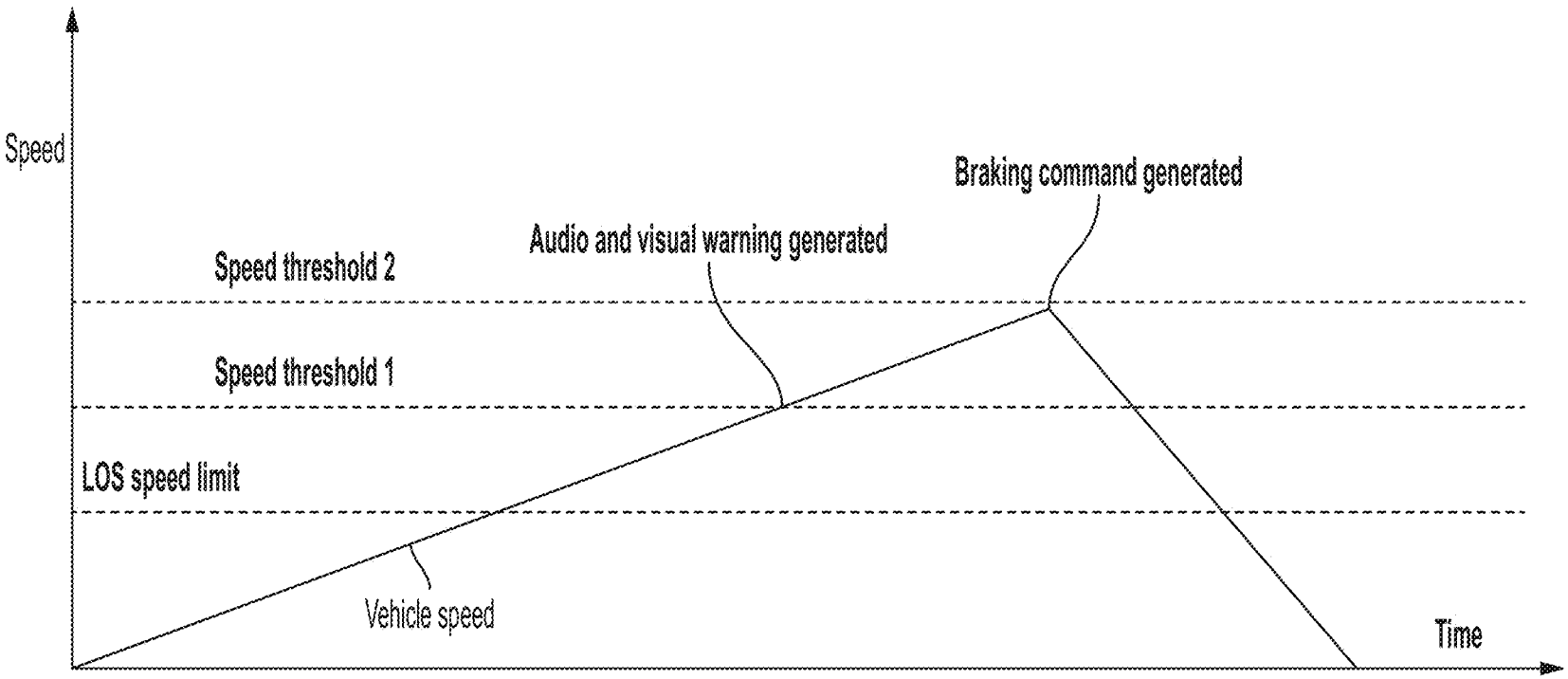
FIG. 2 is a graph of a positioning system operation, in accordance with some embodiments.

FIG. 2 is a graph plotting the speed of a vehicle as the speed of the vehicle increases through various thresholds until a braking command is generated. The graph plots the speed of the vehicle on the vertical axis against time on the horizontal axis. As shown by the graph, the vehicle's speed begins at zero at time zero. As time passes, the vehicle gains speed. The train reaches a LOS speed limit at the first dashed line. The train reaches a first speed threshold (Speed threshold 1) at the second dashed line. When the train reaches the first speed threshold, audio and visual warnings are generated to inform the driver that the first speed threshold has been reached. If the brakes are not applied, the speed of the vehicle continues to increase until a second speed threshold (Speed threshold 2) is reached, indicated by the third dashed line. At this time, a braking command is generated, and the vehicle speed reduces to zero, i.e., the vehicle comes to a stop.

If a vehicle, such as vehicle 102 in FIG. 1, enters a non-CBTC territory, or the position of the vehicle 102 is not determined, or the communication with a MAU 128 is not established, on-board computer 106 supervises that the speed of the vehicle 102 does not exceed the LOS speed limit determined from the vehicle's LOS visible distance along the track. If the speed of the vehicle 102 exceeds the LOS speed limit a warning, e.g., audio and/or visual, is generated to the driver of the vehicle. When the speed increases further, the on-board computer 106 commands the vehicle 102 to brake to a stop.

Figure 3:
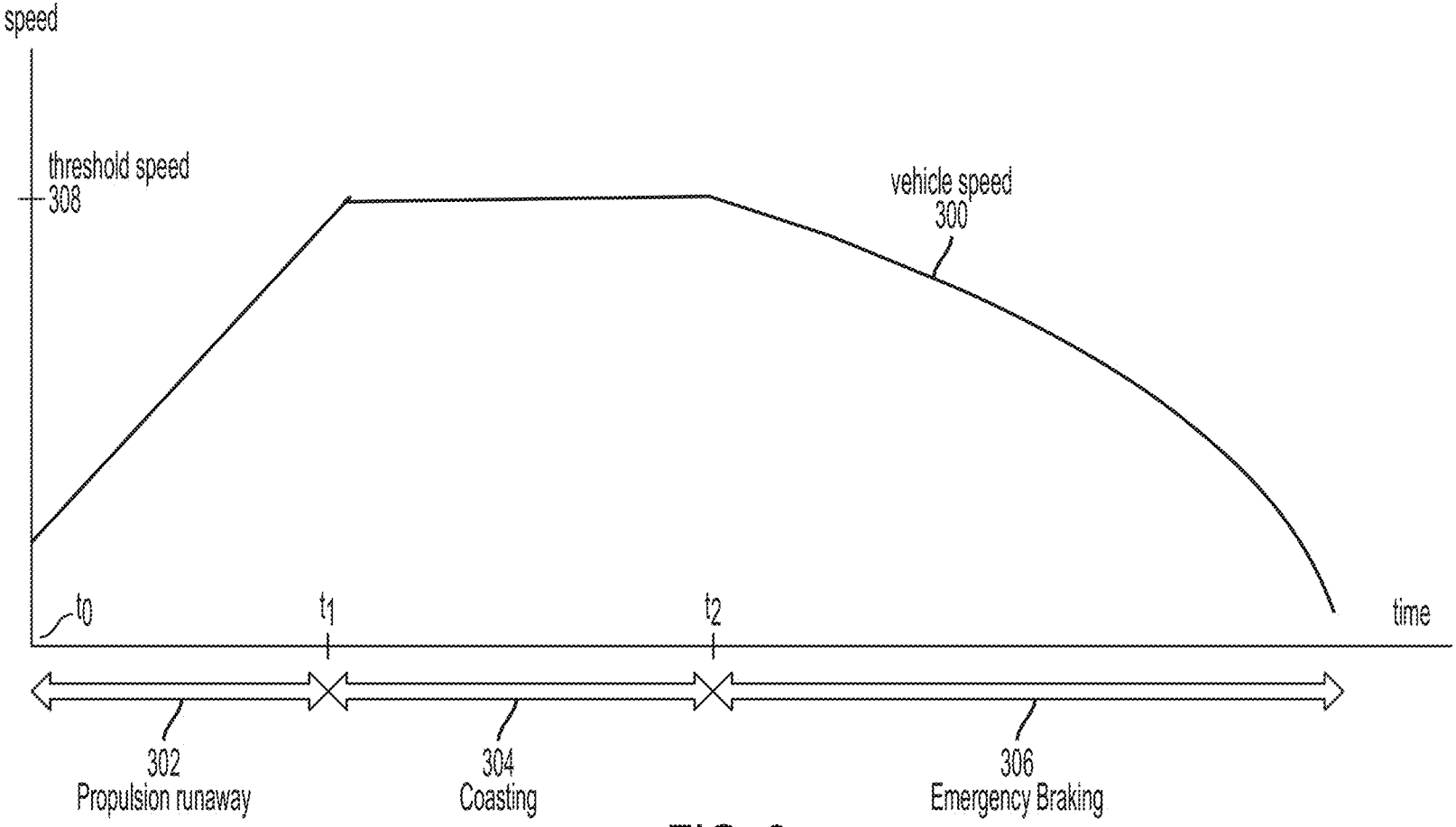
FIG. 3 is a graph of a braking calculation, in accordance with some embodiments.

FIG. 3 is a graph depicting the speed of a vehicle as a propulsion runaway condition is occurred by plotting vehicle speed 300 on the vertical axis against time on the horizontal axis. In a first phase ($t_0$-$t_1$), the vehicle speed is increasing in a propulsion runaway condition 302. When a predetermined threshold speed 308, based on a signal aspect determined by the signal aspect enforcement system of Figure, is reached at $t_1$, signal aspect enforcement system sends an engine cut-off signal. The engine is cut off and the vehicle moves without propulsion during a coasting period 304. At time $t_2$, the signal aspect enforcement system sends a brake request. The emergency brakes are applied during an emergency braking period 306, and the vehicle slows down. In some embodiments, only the braking command is sent which is further decomposed by the vehicle's braking system to an engine (propulsion) cut-off command sent to the propulsion system followed by a braking command to the braking system.

Figure 5:
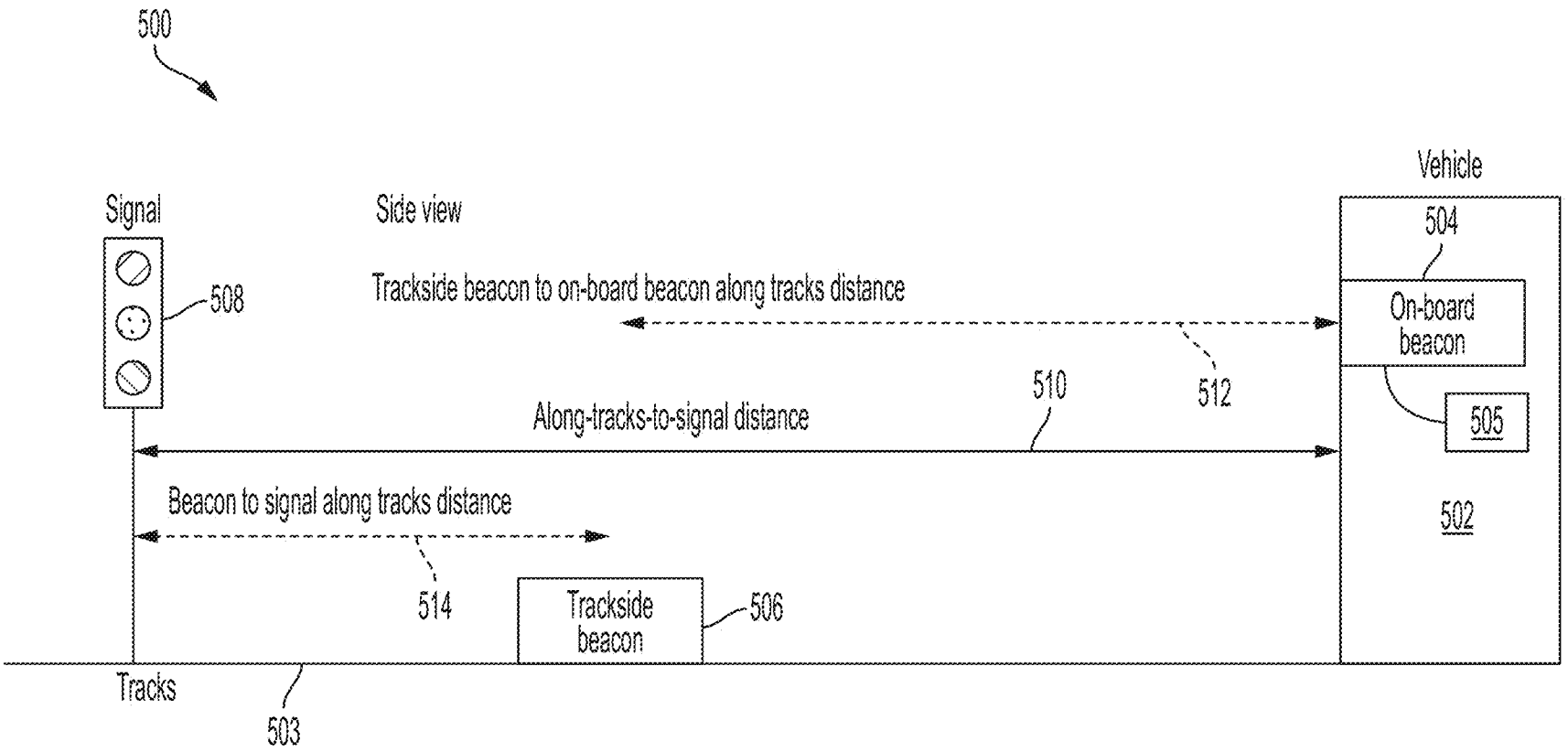
FIG. 5 is a diagram of a trackside beacon installation, in accordance with some embodiments.

FIG. 5 is a diagram 500 of a side-view of a trackside beacon installation, such as beacon system 116 including signal aspect beacon 118 and positioning beacon 120, in accordance with some embodiments. A vehicle 502 moves along a track 503. The vehicle 502 includes an on-board beacon 504 connected to an on-board computer 503. A trackside beacon 506, positioned along the track 503 communicates with the on-board beacon 504. Using time-of-flight information from the communication, the on-board computer 503 determines a first along-tracks distance 512 between the trackside beacon 506 to the on-board beacon 504. A second along-tracks distance 514 from signal 508 to the trackside beacon 506 is communicated by the trackside beacon 506 to the on-board beacon 504 or, in accordance with some embodiments, provided to the on-board computer 505 by guideway map data.

An along-track-to-signal distance 510 to the signal is determined by the on-board computer 505 by adding the first along-tracks distance 512 and the second along-tracks distance 514. The along-track-to-signal distance 510 is the along-track distance from the signal 508 to the vehicle 502. A worst case braking distance for the vehicle 502 at a given location on the track 503 is determined by the on-board computer 505 using the speed of the vehicle 502, the weight of the vehicle 502, the slope of the track 503 and other factors related to qualities of the vehicle or track 503. The speed of the vehicle 502 is controlled by the on-board computer 505 so that the along-track-to-signal distance 510, the distance from the vehicle 503 to the next signal 508, is always greater than the worst case braking distance. If the signal 508 has a red aspect and the worst case braking distance is less than the along-track-to-signal distance, the on-board computer 505 sends a signal to engage the vehicle's emergency brakes (not shown).

A worst case braking distance must be smaller than the smallest LOS distance in the line, otherwise the vehicle's capability to stop before a red signal aspect, such as 134 in FIG. 1, is not guaranteed. The worst case braking distance is compared against an along-tracks distance 510 to the signal. If the signal aspect is red 134 and the worst case braking distance is greater than the along-tracks distance to the signal, emergency brakes are requested.

Figure 6:
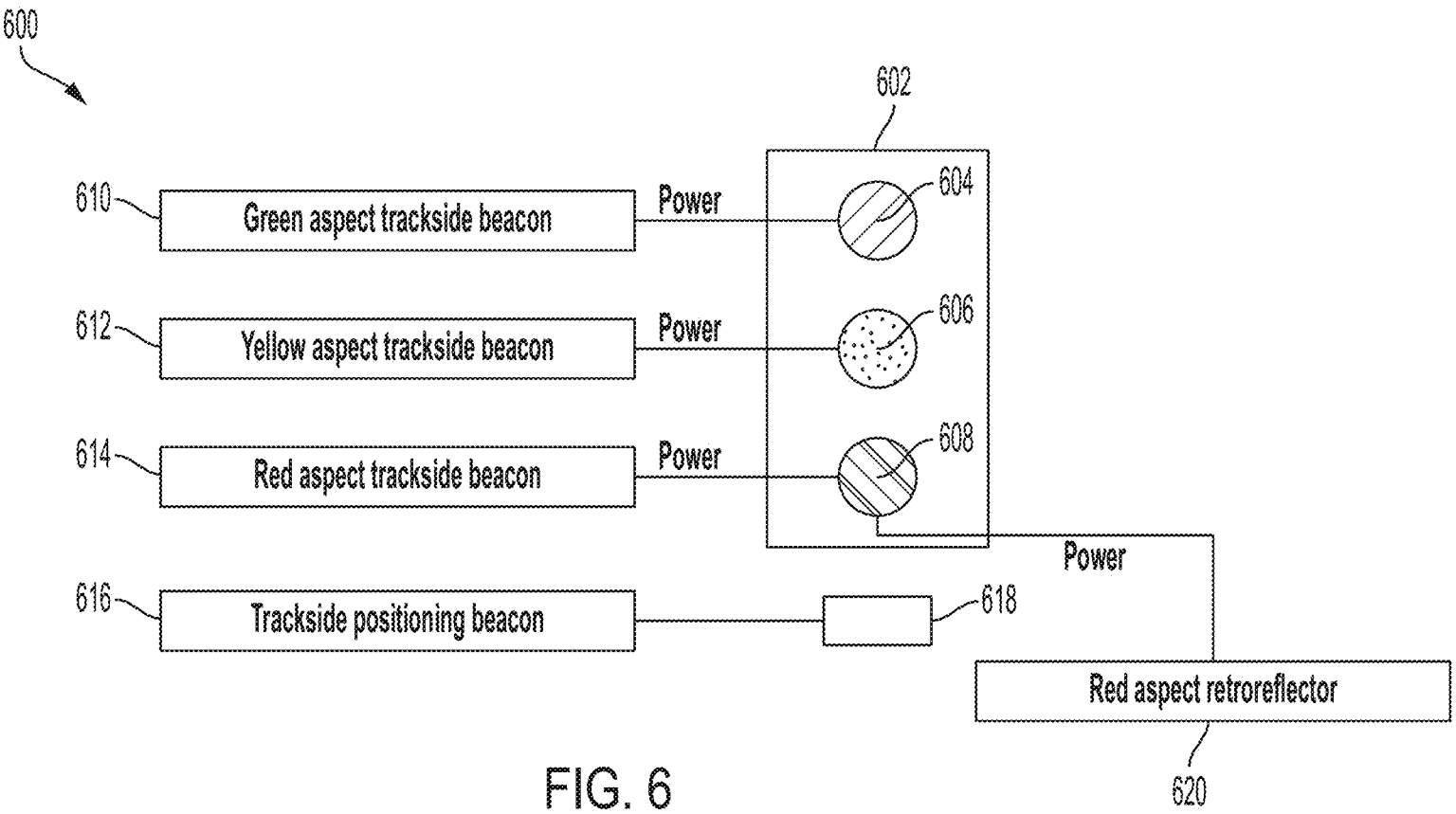
FIG. 6 is a diagram of a signal and trackside beacon and retroreflector arrangement, in accordance with some embodiments.

FIG. 6 is a diagram 600 of a signal and trackside beacons and retroreflector arrangement, in accordance with some embodiments. A signal 602 includes three signal aspects: a green aspect 604, a yellow aspect 606 and a red aspect 608. The green aspect 604 is electrically connected to and sends power to a green aspect trackside beacon 610. The yellow aspect 606 is electrically connected to and sends power to a yellow aspect trackside beacon 612. The red aspect 608 is electrically connected to and sends power to a red aspect trackside beacon 614. A trackside positioning beacon 616 is electrically connected to a power source 618. The red aspect 608 is electrically connected to and sends power to a red aspect retroreflector 620.

Each signal 602 is associated with a retroreflector 620 driven by the red aspect 608 of the signal. In accordance with some embodiments, multiple retroreflectors 620 are implemented. In accordance with some embodiments, the retroreflector 620 is an active retroreflector, such as a Van Atta retroreflector or equivalent, powered by the signal red aspect 608. The retroreflector 620 significantly boosts the strength of the return reflection. For example, if the red aspect 608 is illuminated or "lit" then the associated retroreflector 620 is powered and retro-reflects the radar signal to the radar, such as radar 108 in FIG. 1. If the red aspect 608 is not illuminated or "dark," then no (or a significantly weaker) retro-reflection is observed by the radar. The retroreflector 620 associated with a signal 602 is installed a predetermined distance before the signal, such as signal 128 in FIG. 1, to increase the on-board radar detection range.

Figure 7A:
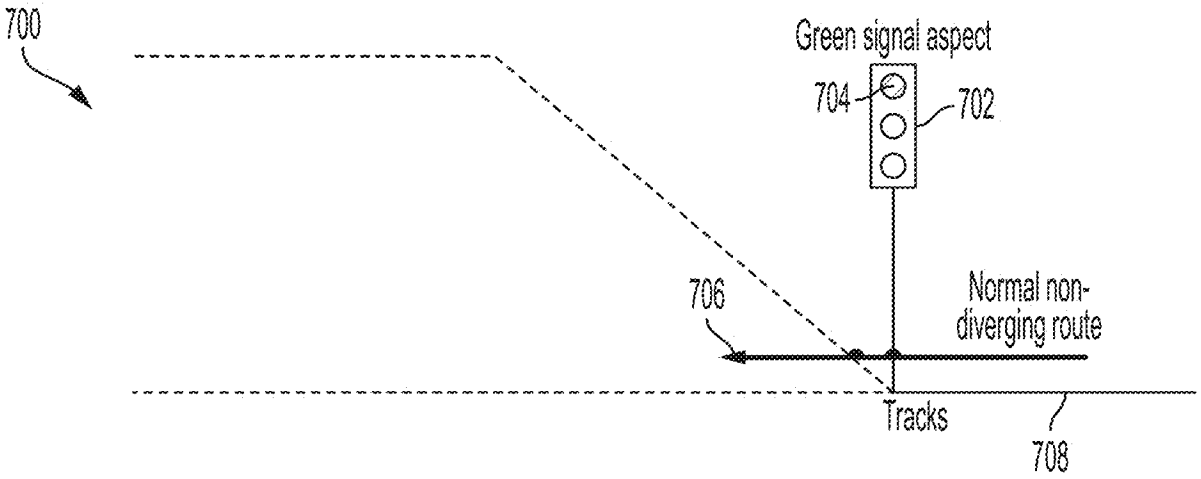
FIGS. 7A and 7B are diagrams of route selection in response to signal aspect, in accordance with some embodiments.
Figure 7B:
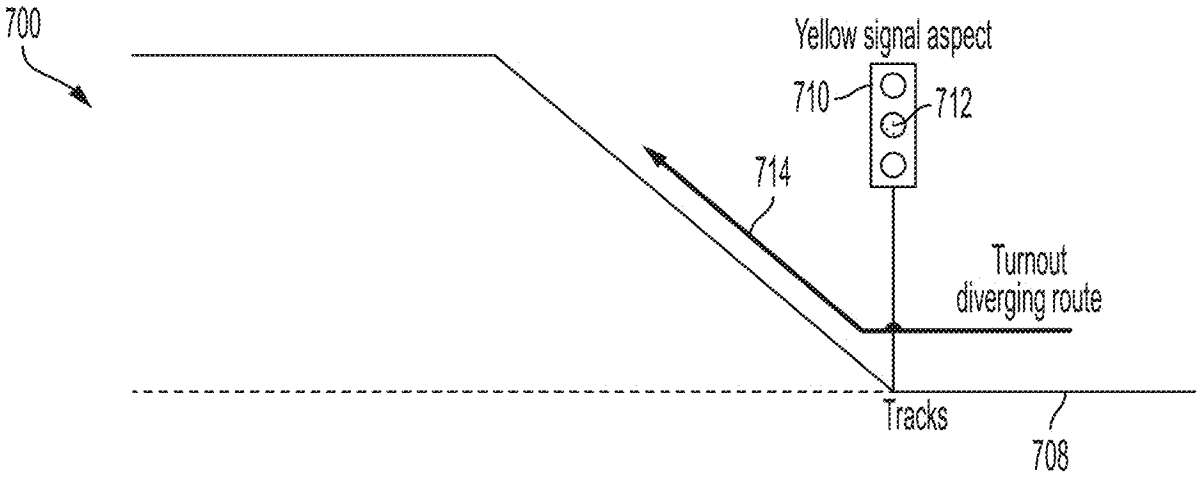

FIGS. 7A and 7B are diagrams 700 of route selection in response to a signal aspect identified by the signal aspect enforcement system shown in FIG. 1, in accordance with some embodiments. A signal 702 showing a green aspect 704 instructs a vehicle, such as vehicle 102 in FIG. 1, to take a normal, non-diverging route 706 as the vehicle moves along the tracks 708. A signal 710 showing a yellow aspect 712 instructs a vehicle, such as vehicle 102 in FIG. 1, to take a turnout diverging route 714.

The on-board computer 106 determines the reaction to the signal aspect. For example: red aspect: stop before the signal, yellow aspect: proceed with the speed limit specified in the database for yellow aspect and green aspect: proceed with the speed limit specified in the database for green aspect. The on-board computer 106 determines the route based on the signal aspect.

Figure 8:
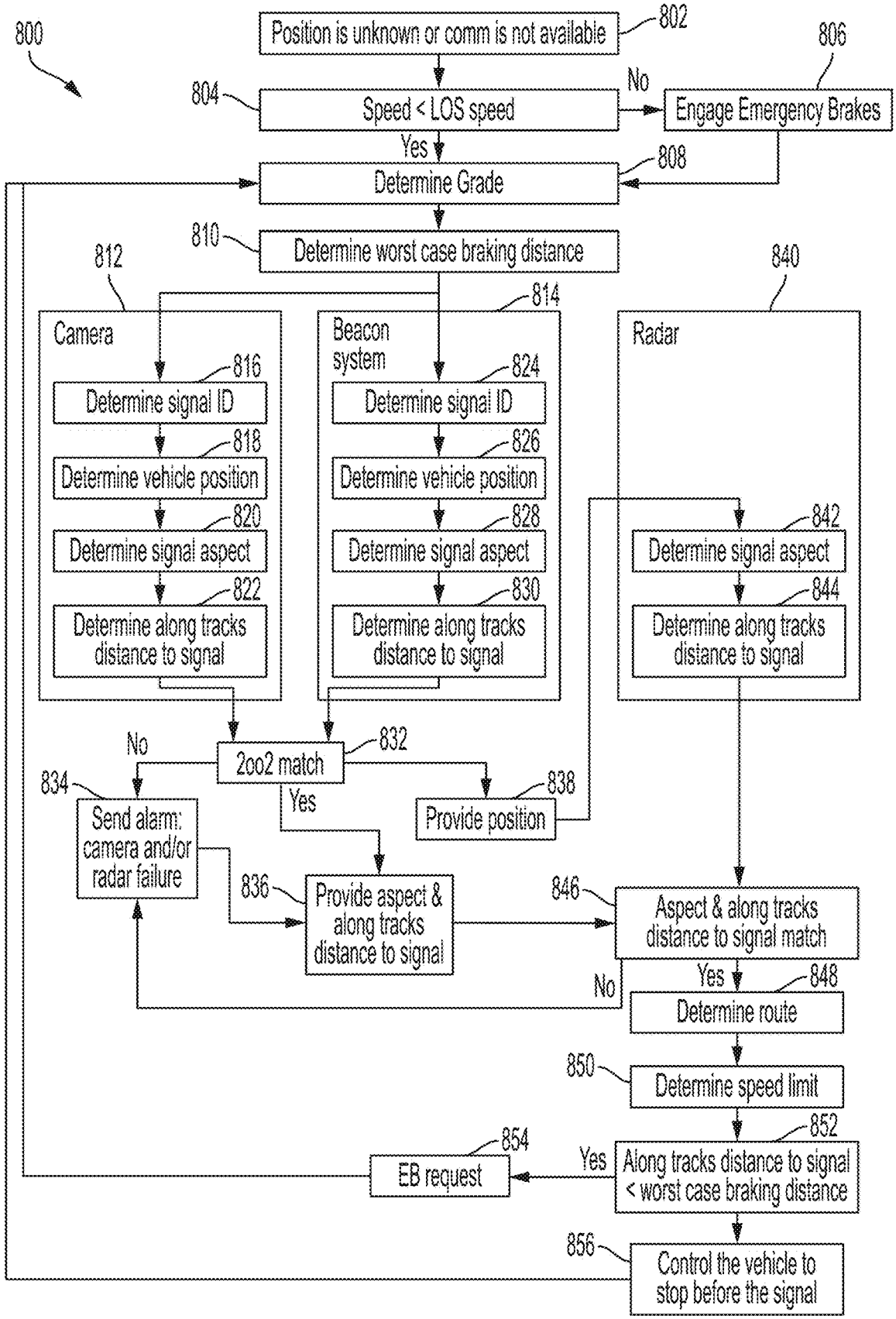
FIG. 8 is a flowchart of a signal aspect enforcement method, in accordance with some embodiments.

FIG. 8 is a flowchart 800 of a signal aspect enforcement method, in accordance with some embodiments. Initially, the position of a vehicle, such as vehicle 102 in FIG. 1, is unknown or communication with the vehicle is not available and the flow begins in process 802. The flow proceeds to process 804 wherein the process determines if the vehicle speed is less than the maximum LOS speed. If the speed is not less than the maximum LOS speed, the flow proceeds to process 806 and the emergency brakes are engaged. If the speed is less than the maximum LOS speed or emergency brakes have been engaged, the flow continues to process 808 where the grade of the tracks is determined. The flow continues to process 810 wherein the worst case braking distance for the vehicle is determined.

The flow then proceeds in parallel to a camera process 812 and a beacon system process 814 to determine vehicle and signal parameters. In accordance with other embodiments, the camera process 812 and the beacon system process 814 proceed serially. In at least one embodiment, camera process 812 proceeds prior to beacon system process 814. The processes 812 and 814 proceed simultaneously or nearly simultaneously, because the data generated by the processes represent the vehicle's current position and situation and then the two sets of data are compared. A camera, such as camera 110 in FIG. 1, generates image data representing the guideway near the vehicle including a signal, such as signal 124 in FIG. 1. The camera process 812 begins by using image and color recognition processes to determine the signal ID of the signal from the image data generated by the camera in process 816. The vehicle position is determined from the signal ID in process 818. The signal aspect of the signal 124 is determined using color and image recognition processes on the image data generated by the camera in process 820. The distance along the tracks from the vehicle to the signal is determined from visual data generated by the camera in step 822.

The camera 110 is installed on-board the vehicle 102 looking forward. The images/frames captured by the camera 110 are processed, using machine vision algorithms and/or neural network algorithms to identify the signal ID in process 816 and the associated aspects in process 820. The signal ID and aspect are checked to verify the consistency with the expected signal ID and aspect, that the signal ID identified based on the camera images/frames is a valid signal ID contained in the guideway map database, that the number of aspects identified based on the camera images/frames matches the expected number of aspects specified in the database, that the aspect's colour is identified based on the camera's images/frames matches the expected colours specified in the database, that the signal aspects spatial arrangement matches the expected spatial arrangement specified in the guideway map database.

If the checks to verify consistency are repeatedly passed, for a predetermined minimum number of check cycles (typically 3), then the signal attributes are deemed verified.

The on-board controller determines the along-tracks distance to the signal in process 822 and determines the position of the vehicle in process 818 on the guideway (based on the signal ID, the signal location on the map and the along-tracks distance to the signal) and the aspect of the signal.

TABLE 1

| Signal aspect | Red | Yellow | Green |
|---|---|---|---|
| Red aspect | Power on | Power off | Power off |
| Yellow Aspect | Power off | Power on | Power off |
| Green Aspect | Power off | Power off | Power on |
| Positioning | Power on | Power on | Power on |

The beacon system process 814 begins by determining the signal ID from data received from the signal aspect beacon in process 824. The vehicle position is determined using time-of-flight information and data from the guideway map in process 826. The signal aspect is determined from data received from the signal aspect beacon in process 828. The distance along the tracks from the vehicle to the signal is determined from the time-of-flight information and data from the guideway map in process 830.

The on-board beacons, such as on-board beacons 112 in FIG. 1, periodically scan which trackside beacons, such as trackside beacons 116 in FIG. 1, are available within a predefined range (typically 200 m or longer). If a trackside beacon 116 is within the scanning range, the trackside beacon 116 responds to the on-board beacon 112 with the trackside beacon ID. Then, the on-board beacon determines the range to the trackside beacon, based on time of flight or equivalent techniques, and report the range and beacon's ID to the on-board computer 106.

The on-board computer 106 checks if the trackside beacon ID is associated with a signal in process 824. The on-board computer 106 determines the vehicle position on the guideway based on at least one signal aspect trackside beacon 118 and one positioning trackside beacon 120 associated with the signal in process 826. The on-board computer 106 determines the signal aspect reported by the trackside beacon 116 in process 828.

The on-board computer 106 converts the range measured by the on-board beacon 112 to the along-tracks distance to the signal aspect trackside beacon 118 and determines the along-tracks distance to the signal in process 830.

The parameters determined by the camera process 812 and the beacon system process 814 are then compared in process 832 to determine if there is a two-out-of-two (2oo2) match. In 2oo2 duplex voting, both the data from the camera and the data from the beacon system must "agree" to proceed. If there is not a match, the process sends an alarm indicating a camera and/or radar failure in process 834. The alarm is sent to the vehicle on-board controller and in some cases to a diagnostics computer located at the central control room or maintenance depot. This check provides a high level of safety integrity. In some embodiments, the level of safety integrity is Safety Integrity Level (SIL) 4. For a device to be rated as SIL 4, the device is required to have demonstrable on-demand reliability. SIL 4 is based on International Electrotechnical Commission's (IEC) standard IEC 61508 and EN 50126 and EN 50129 standards. SIL 4 requires the probability of failure per hour to range from $10^{-8}$ to $10^{-9}$. These checks include a 2oo2 voting between the signal ID and signal aspect determined based on the camera and the beacon system.

The signal ID and aspect derived from the camera images/frames and the beacon system must be an exact match, otherwise the brakes are applied. In some cases, due to visibility constraints, weather or other environmental conditions, the camera does not detect the signal. The signal's attributes from the beacon system is trusted and an alarm is sent indicating camera failure. This is because the camera is more sensitive to weather and environmental influences.

At times, the signal aspect becomes "dark" (i.e., the signal aspect is commanded to be illuminated or "lit" but the signal aspect is not illuminated ("dark")). In this situation, the beacon system does detect the correct signal aspect. If the beacon system determines that an aspect is "on" but the camera does not while no other aspect is determined on by the camera, then the beacon system is trusted and an alarm is sent indicating a not illuminated or "dark" aspect.

The vehicle's position derived from the camera images/frames and the beacon system must agree within a predetermined range (typically 5 m), otherwise the brakes are applied. If the vehicle position derived from the camera images/frames and the beacon system agree within the expected range, then the vehicle's position derived from the beacon system is used because the beacon system is more accurate than the camera.

The vehicle position derived from the beacon system is used to determine an along-tracks position window (typically 5 m to 10 m) in which a retroreflector associated with the signal red aspect is expected to be detected. The vehicle position derived from the beacon system is more accurate than the position derived by the camera. The beacon system has a greater range than the camera system.

If the retroreflector is detected within the expected window, a check is performed to verify that the signal aspect derived based on the 2oo2 voting between the camera and the beacon system is red. If the signal aspect derived based on the 2oo2 voting between the camera and the beacon system is red, the signal aspect is confirmed to be red otherwise an alarm is sent indicating radar failure.

If the retroreflector is not detected within the expected window, a check is performed to verify that the signal aspect derived based on the 2oo2 voting between the camera and the beacon system is not red. If the signal aspect derived based on the 2oo2 voting between the camera and the beacon system is not red, the signal aspect derived based on the 2oo2 voting between the camera and the beacon system is confirmed, otherwise an alarm is sent indicating radar failure.

If there is a 2oo2 match in step 832 or an alarm has been sent in step 834, the process provides the signal aspect and the distance along the track from the vehicle to the signal. The process provides the vehicle position in process 838 to a radar process 840. The on-board computer 106 determines the signal aspect using on-board radar 106 and retroreflector 122 in process 842 and determines the distance along the tracks from the vehicle to the signal in process 844. These values are compared in process 846 to the aspect and distance along the tracks from the vehicle to the signal provided by process 836. If the values do not match in process 846, an alarm is sent indicating a camera and/or radar failure in process 834. If the values match in process 846, the process determines the route in process 848. The process determines the speed limit in process 850. The process determines if the distance along the tracks from the vehicle to the signal is less than the worst case braking distance in process 852. If the distance along the tracks from the vehicle to the signal is less than the worst case braking distance, the process makes an emergency brake request at process 854 and returns to process 808 to determine the grade of the track. If the distance along the tracks from the vehicle to the signal is not less than the worst case braking distance, the process controls the vehicle to stop before the signal is reached in process 856 and the flow returns to process 808.

Figure 9:
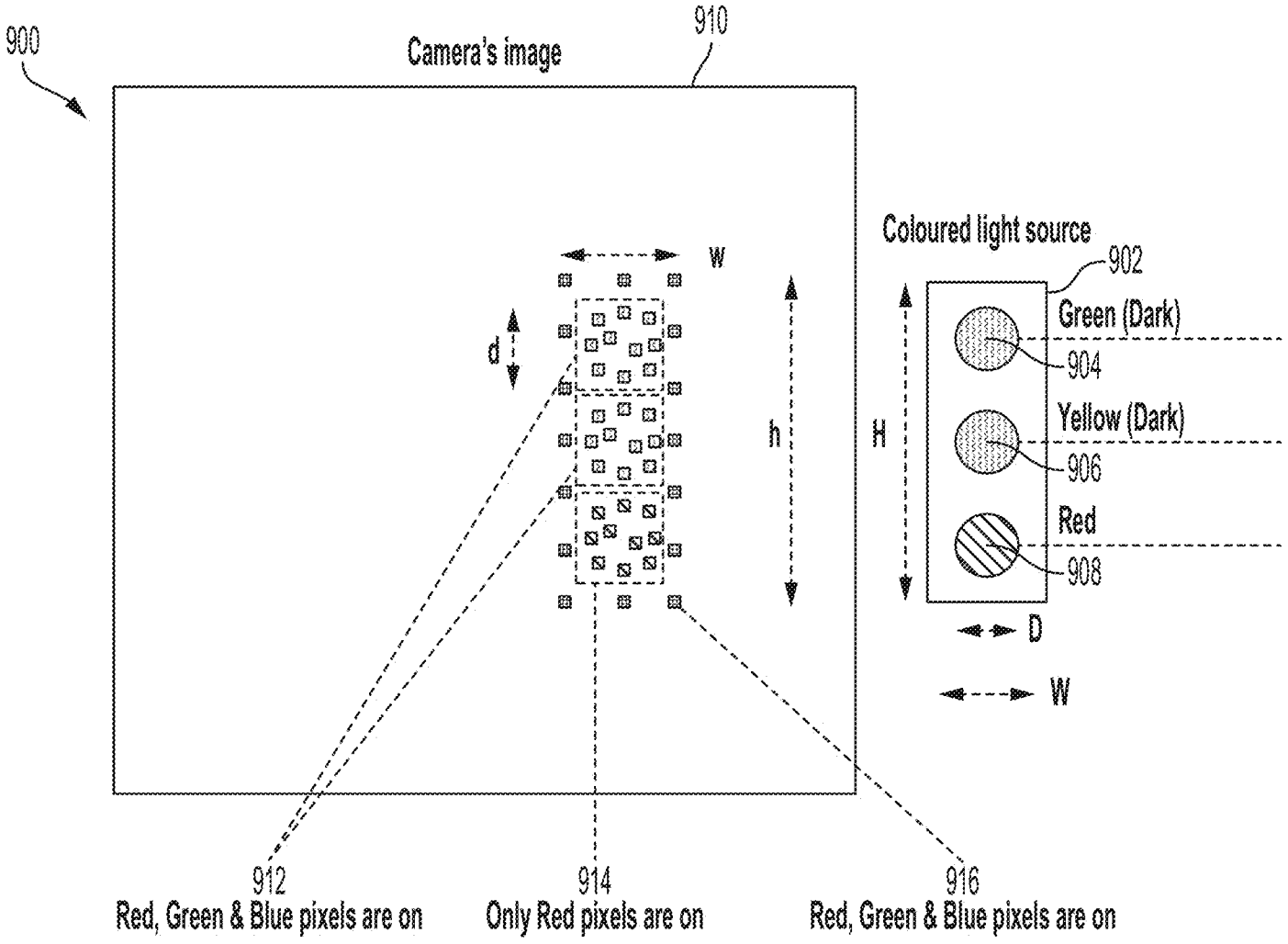
FIG. 9 is a diagram of a camera built-in test with an external light source, in accordance with some embodiments.

FIG. 9 is a set-up 900 for conducting a camera built-in test (testing for the color red) with external colored light source, in accordance with some embodiments. An external colored light source 902 includes areas corresponding to the green aspect 904, the yellow aspect 906 and the red aspect 908 of a signal. The external colored light source 902 has a height H and a width W. The colored aspects 904, 906 and 908 are circular and have diameters D. The camera generates an image 910. The camera searches the image 910 for red, green and blue pixels that form a shape 916 having a height h and a width w. The camera identifies three areas within the shape 916 having a diameter d, two of the areas 912 are "dark" having red, green and blue pixels on and the third area 914 having only red pixels on.

The method of checking the camera's health includes pixels and pixel colors health check, pattern check, location within the FOV check, size check and intensity check.

The images/frames 910 reported by the camera are compared against the expected images/frames while the camera is facing a colored light source 902 and/or colored signs with a known pattern, installed on or near the camera housing or on the wayside at known locations, while the camera distance from the colored light source 902 and/or colored signs is within a known distance range.

Figure 10:
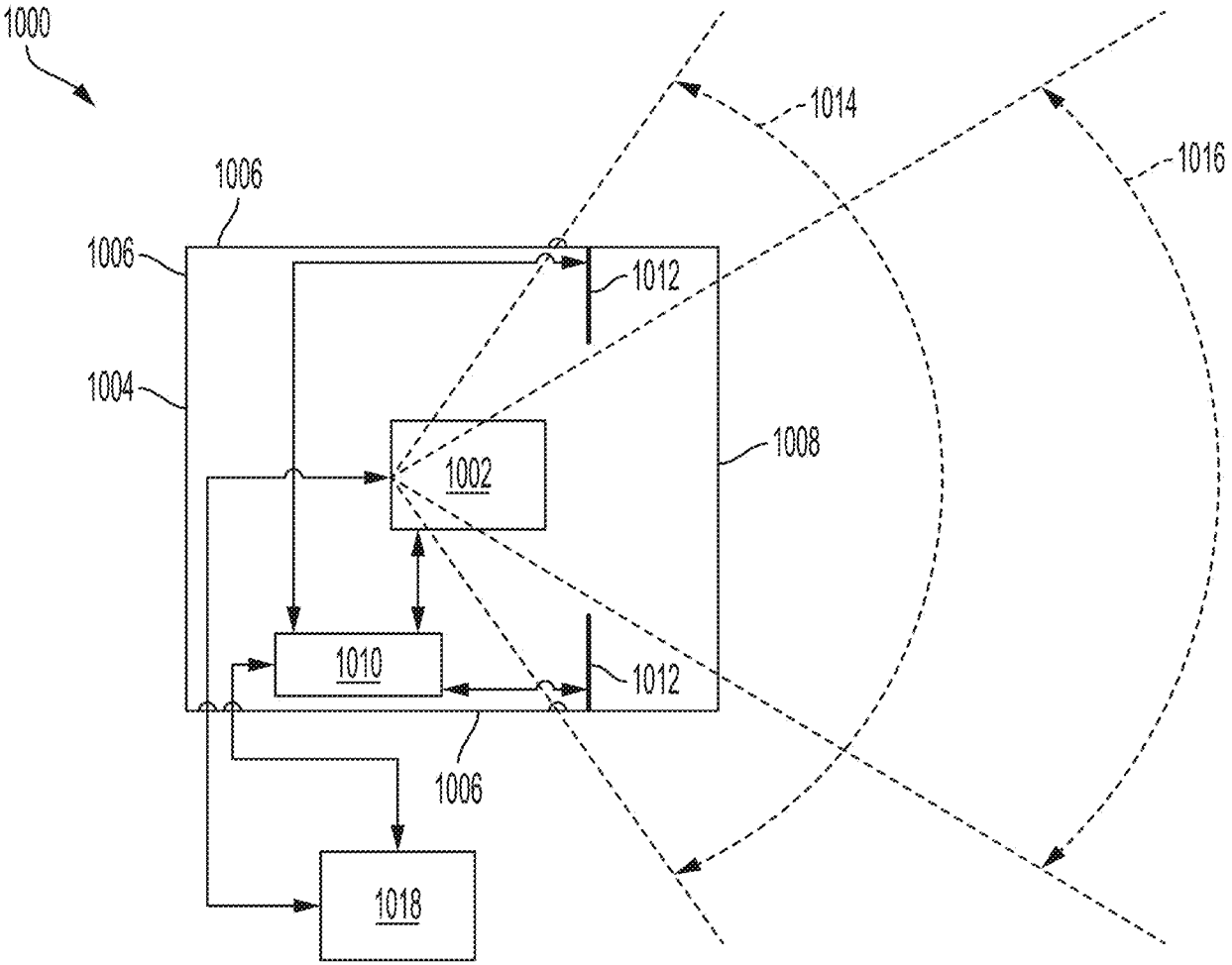
FIG. 10 is a diagram of a camera built-in test with an internal light source (right side), in accordance with some embodiments.

FIG. 10 is a diagram 1000 of a camera test system, in accordance with some embodiments. A camera 1002 is positioned within a camera enclosure 1004 having three non-transparent surfaces 1006 and a transparent surface 1008. The camera 1002 is communicably connected with a microcontroller unit (MCU) 1010. Within the camera enclosure 1004, two colored light sources 1012 are positioned so that they are within the camera's outer field of view (FOV) 1014 but outside of the camera's inner FOV 1016. The two colored light sources 1012 are communicably connected with the MCU 1010. The MCU 1010 is communicably connected with a computer 1018. The camera 1002 is communicably connected with computer 1018.

The signal aspect enforcement system and method, in accordance with an embodiment, checks the health of a visible spectrum/near IR/LWIR camera 1002 with a dedicated colored light source 1012 installed at the camera's enclosure 1004.

The images/frames reported by the camera 1002 are compared against the expected images/frames while the camera 1002 is facing a colored light source 1012, with known pattern, installed at the camera's enclosure 1004.

Figure 11:
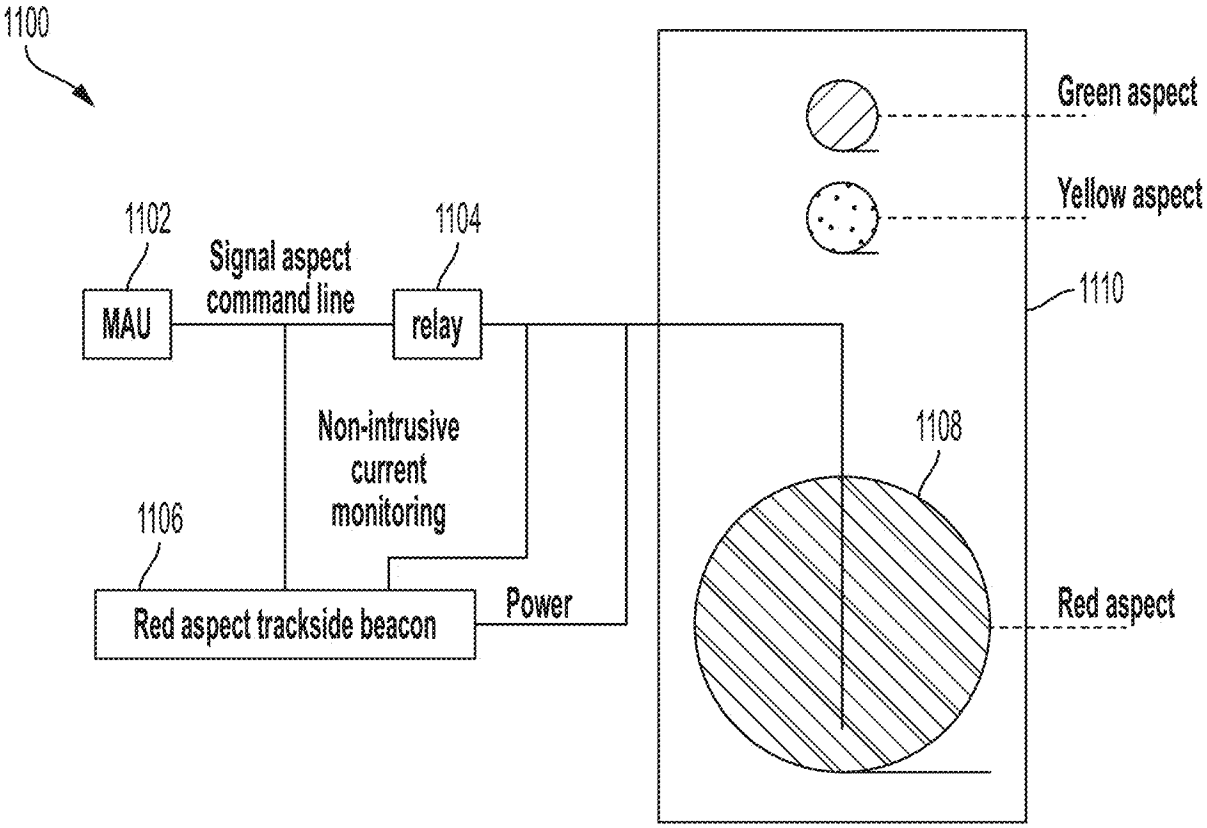
FIG. 11 is a diagram of a signal aspect command line and non-intrusive current monitoring, in accordance with some embodiments.

FIG. 11 is a diagram 1100 of a signal aspect command line and non-intrusive current monitoring, in accordance with some embodiments. A MAU 1102 is communicably connected with a relay 1104. The MAU 1102 is communicably connected with a red aspect trackside beacon 1106. The MAU 1102 communicates a signal aspect command line to the relay 1104 and the red aspect trackside beacon 1106. The relay 1104 is electrically connected to and provides power to the red aspect 1108 of a signal 1110. The relay is electrically connected to and provides power to the red aspect trackside beacon 1106. The red aspect trackside beacon 1106 monitors the power from the relay 1104 using non-intrusive current monitoring.

The signal aspect beacon 1106, using non-intrusive current monitoring by placing an inductive coil on the signal aspect command line and the filament of the red aspect 1108, detects if the signal aspect 1108 is on and actually illuminated or "lit."

Figure 12:
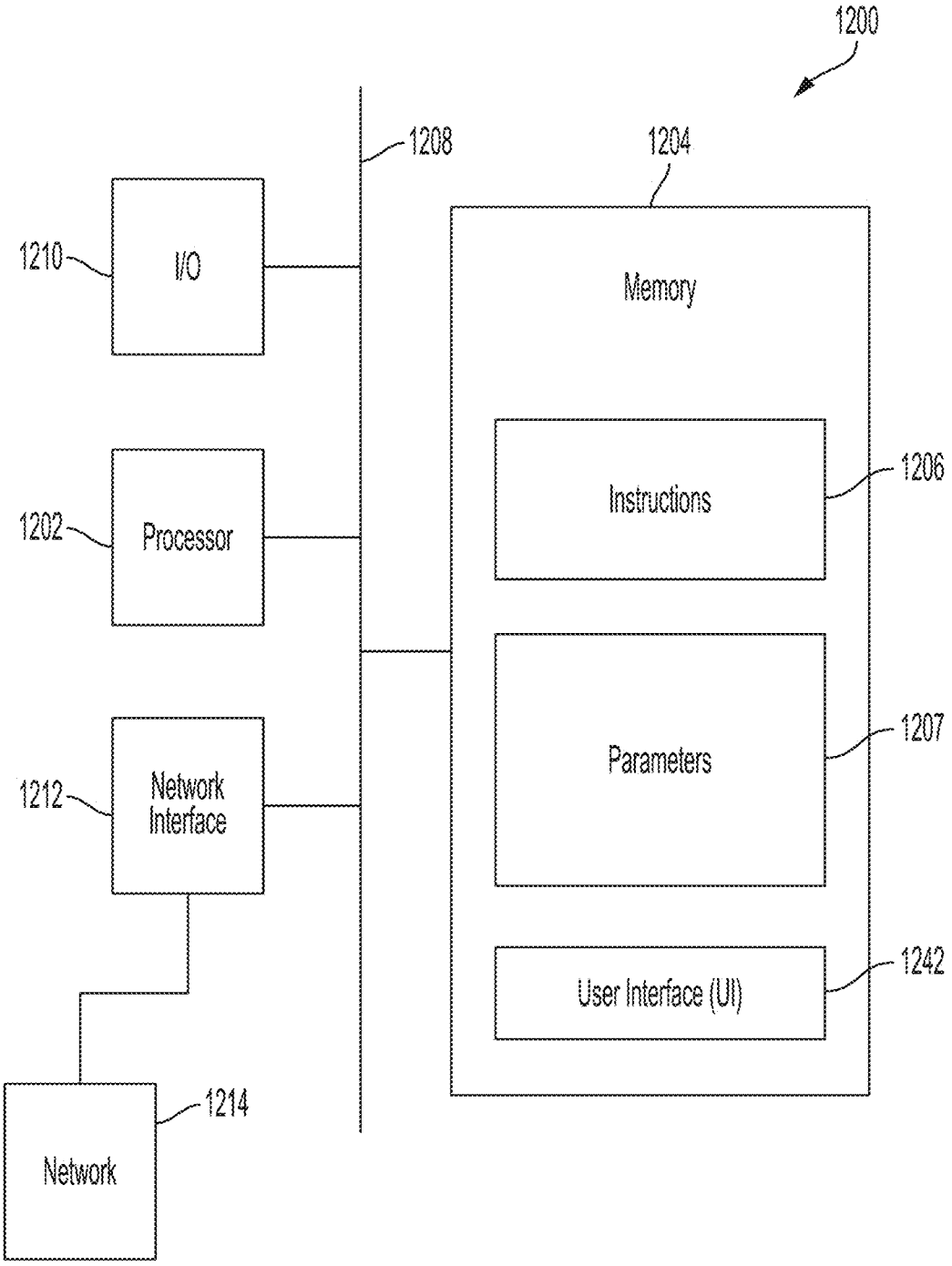
FIG. 12 is a high-level block diagram of a processor-based system usable in conjunction with one or more embodiments.

FIG. 12 is a block diagram of an on-board computer 1200 in accordance with some embodiments.

In some embodiments, the on-board computer 1200 is a general purpose computing device including a hardware processor 1202 and a non-transitory, computer-readable storage medium 1204. Storage medium 1204, amongst other things, is encoded with, i.e., stores, computer program code 1206, i.e., a set of executable instructions. Execution of instructions 1206 by hardware processor 1202 represents (at least in part) a movement control tool which implements a portion or all of the methods described herein in accordance with one or more embodiments (hereinafter, the noted processes and/or methods).

Processor 1202 is electrically coupled to computer-readable storage medium 1204 via a bus 1208. Processor 1202 is also electrically coupled to an I/O interface 1210 by bus 1208. A network interface 1212 is also electrically connected to processor 1202 via bus 1208. Network interface 1212 is connected to a network 1214, so that processor 1202 and computer-readable storage medium 1204 are capable of connecting to external elements via network 1214. Processor 1202 is configured to execute computer program code 1206 encoded in computer-readable storage medium 1204 in order to cause system 1200 to be usable for performing a portion or all of the noted processes and/or methods. In one or more embodiments, processor 1202 is a central processing unit (CPU), a multi-processor, a distributed processing system, an application specific integrated circuit (ASIC), and/or a suitable processing unit.

In one or more embodiments, computer-readable storage medium 1204 is an electronic, magnetic, optical, electromagnetic, infrared, and/or a semiconductor system (or apparatus or device). For example, computer-readable storage medium 1204 includes a semiconductor or solid-state memory, a magnetic tape, a removable computer diskette, a random access memory (RAM), a read-only memory (ROM), a rigid magnetic disk, and/or an optical disk. In one or more embodiments using optical disks, computer-readable storage medium 1204 includes a compact disk-read only memory (CD-ROM), a compact disk-read/write (CD-R/W), and/or a digital video disc (DVD).

In one or more embodiments, storage medium 1204 stores computer program code 1206 configured to cause the on-board computer 1200 to be usable for performing a portion or all of the noted processes and/or methods. In one or more embodiments, storage medium 1204 also stores information which facilitates performing a portion or all of the noted processes and/or methods. In one or more embodiments, storage medium 1204 stores parameters 1207.

The on-board computer 1200 includes I/O interface 1210. I/O interface 1210 is coupled to external circuitry. In one or more embodiments, I/O interface 1210 includes a keyboard, keypad, mouse, trackball, trackpad, touchscreen, and/or cursor direction keys for communicating information and commands to processor 1202.

The on-board computer 1200 also includes network interface 1212 coupled to processor 1202. Network interface 1212 allows system 1200 to communicate with network 1214, to which one or more other computer systems are connected. Network interface 1212 includes wireless network interfaces such as BLUETOOTH, WIFI, WIMAX, GPRS, or WCDMA; or wired network interfaces such as ETHERNET, USB, or IEEE-1264. In one or more embodiments, a portion or all of noted processes and/or methods, is implemented in two or more systems 1200.

The on-board computer 1200 is configured to receive information through I/O interface 1210. The information received through I/O interface 1210 includes one or more of instructions, data, design rules, libraries of standard cells, and/or other parameters for processing by processor 1202. The information is transferred to processor 1202 via bus 1208. The on-board computer 1200 is configured to receive information related to a UI through I/O interface 1210. The information is stored in computer-readable medium 1204 as user interface (UI) 1242.

In some embodiments, a portion or all of the noted processes and/or methods is implemented as a standalone software application for execution by a processor. In some embodiments, a portion or all of the noted processes and/or methods is implemented as a software application that is a part of an additional software application. In some embodiments, a portion or all of the noted processes and/or methods is implemented as a plug-in to a software application.

In some embodiments, the processes are realized as functions of a program stored in a non-transitory computer readable recording medium. Examples of a non-transitory computer readable recording medium include, but are not limited to, external/removable and/or internal/built-in storage or memory unit, e.g., one or more of an optical disk, such as a DVD, a magnetic disk, such as a hard disk, a semiconductor memory, such as a ROM, a RAM, a memory card, and the like.

A signal aspect enforcement method for a rail vehicle with an unknown position is performed by receiving speed measurements from speed measuring device by an on-board controller and determining using the received speed measurements if rail vehicle speed is less than a predetermined line-of-sight threshold speed. The on-board controller receives grade measurements from a grade measuring device by the on-board controller and determines the grade of the rail. The on-board controller determines the worst-case braking distance of the rail vehicle using the rail vehicle speed and grade of rail. The on-board controller receives image data including a first signal aspect from a camera system and beacon/radio data including a second signal aspect from a beacon/radio system. The on-board controller determines if the first signal aspect matches the second signal aspect and determines route of rail vehicle and speed limit of rail vehicle by the on-board controller based on the first signal aspect.

When the rail vehicle speed is greater than a line-of-sight threshold speed, the on-board controller outputs a brake request.

The image data includes signal identification and the on-board controller uses the signal identification to determine the position of the rail vehicle.

The beacon/radio data includes signal identification and the on-board controller uses the signal identification to determine the position of the rail vehicle.

The image data includes signal identification and the on-board controller uses the signal identification to determine the position of the rail vehicle and the beacon/radio data includes signal identification and the on-board controller uses the signal identification to determine the position of the rail vehicle.

The on-board controller uses the image data to determine a first along-tracks distance to a signal and the beacon/radio data to determine a second along-tracks distance to a signal.

The on-board controller performs tests on the camera to confirm the camera's ability to identify shapes and colours.

A signal aspect enforcement system for a rail vehicle includes an on-board controller, a camera system, in communication with the on-board controller, generating image data including signal aspect to the on-board controller, a beacon/radio system, in communication with the on-board controller, providing received beacon/radio data including signal aspect and signal location to the on-board controller and a radar system, in communication with the on-board controller, providing radar data to the on-board controller. The on-board controller is configured to use the image data, the received beacon/radio data and the radar data to determine signal aspect.

The on-board controller is configured to receive rail vehicle speed measurement from a speed measuring device and determines if the measured rail vehicle speed is less than a predetermined line-of-sight threshold speed.

The on-board controller is configured to receive rail grade measurements from a rail grade measuring device and determines the rail grade.

The on-board controller is configured to use the rail vehicle speed and the rail grade to determine a worst case braking distance for the rail vehicle.

The radar data is processed by the on-board controller to determine the along-tracks distance to signal.

The on-board controller is configured to determine the route and speed limit.

The on-board controller is configured to perform tests on the camera to confirm the camera's ability to identify shapes and colours.

A signal aspect enforcement method for a rail vehicle includes receiving speed measurements from speed measuring device by an on-board controller and determining using the received speed measurements if rail vehicle speed is less than a predetermined line-of-sight threshold speed. The on-board controller receives grade measurements from a grade measuring device by the on-board controller and determining grade of rail and determines the worst-case braking distance of the rail vehicle using the rail vehicle speed and grade of rail. The on-board controller receives image data including a first signal aspect from a camera system and beacon/radio data including a second signal aspect from a beacon/radio system by the on-board controller and determines if the first signal aspect matches the second signal aspect. The on-board controller determines the route of rail vehicle and speed limit of rail vehicle by the on-board controller based on the first signal aspect When the rail vehicle speed is greater than a line-of-sight threshold speed, the on-board controller outputs a brake request and the image data includes signal identification and the on-board controller uses the signal identification to determine the position of the rail vehicle.

The beacon/radio data includes signal identification and the on-board controller uses the signal identification to determine the position of the rail vehicle.

The image data includes signal identification and the on-board controller uses the signal identification to determine the position of the rail vehicle and the beacon/radio data includes signal identification and the on-board controller uses the signal identification to determine the position of the rail vehicle.

The on-board controller uses the image data to determine a first along-tracks distance to a signal and the beacon/radio data to determine a second along-tracks distance to a signal.

When the first along-tracks distance to a signal does not match the second along-tracks distance to a signal, the computer output indicates an alarm.

The on-board controller performs tests on the camera to confirm the camera's ability to identify shapes and colours.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A signal aspect enforcement method for a rail vehicle with an unknown position comprising:

receiving speed measurements from speed measuring device by an on-board controller;

determining using the received speed measurements if rail vehicle speed is less than a predetermined line-of-sight threshold speed;

receiving grade measurements from a grade measuring device by the on-board controller and determining grade of rail;

determining worst-case braking distance of the rail vehicle using the rail vehicle speed and grade of rail;

receiving image data including a first signal aspect from a camera system and beacon/radio data including a second signal aspect from a beacon/radio system by the on-board controller;

determining if the first signal aspect matches the second signal aspect; and determining route of rail vehicle and speed limit of rail vehicle by the on-board controller based on the first signal aspect.

2. The method of claim 1, wherein when the rail vehicle speed is greater than a line-of-sight threshold speed, the on-board controller outputs a brake request.

3. The method of claim 1, wherein the image data includes signal identification and the on-board controller uses the signal identification to determine the position of the rail vehicle.

4. The method of claim 1, wherein the beacon/radio data includes signal identification and the on-board controller uses the signal identification to determine the position of the rail vehicle.

5. The method of claim 1, wherein the image data includes signal identification and the on-board controller uses the signal identification to determine the position of the rail vehicle and the beacon/radio data includes signal identification and the on-board controller uses the signal identification to determine the position of the rail vehicle.

6. The method of claim 1, wherein the on-board controller uses the image data to determine a first along-tracks distance to a signal and the beacon/radio data to determine a second along-tracks distance to a signal.

7. The method of claim 1, wherein the on-board controller performs tests on the camera to confirm the camera's ability to identify shapes and colours.

8. A signal aspect enforcement system for a rail vehicle comprises:

an on-board controller;

a camera system, in communication with the on-board controller, generating image data including signal aspect to the on-board controller;

a beacon/radio system, in communication with the on-board controller, providing received beacon/radio data including signal aspect and signal location to the on-board controller; and a radar system, in communication with the on-board controller, providing radar data to the on-board controller;

wherein the on-board controller is configured to use the image data, the received beacon/radio data and the radar data to determine signal aspect, and wherein the on-board controller is configured to use the rail vehicle speed and the rail grade to determine a worst case braking distance for the rail vehicle.

9. The system of claim 8, wherein the on-board controller is configured to receive rail vehicle speed measurement from a speed measuring device and determines if the measured rail vehicle speed is less than a predetermined line-of-sight threshold speed.

10. The system of claim 8, wherein the on-board controller is configured to receive rail grade measurements from a rail grade measuring device and determines the rail grade.

11. The system of claim 8, wherein the radar data is processed by the on-board controller to determine the along-tracks distance to signal.

12. The system of claim 8, wherein the on-board controller is configured to determine the route and speed limit.

13. The system of claim 8, wherein the on-board controller is configured to perform tests on the camera to confirm the camera's ability to identify shapes and colours.

14. The method of claim 8, wherein the on-board controller uses the image data to determine a first along-tracks distance to a signal and the beacon/radio data to determine a second along-tracks distance to a signal.

15. A signal aspect enforcement method for a rail vehicle comprising:

receiving speed measurements from speed measuring device by an on-board controller;

determining using the received speed measurements if rail vehicle speed is less than a predetermined line-of-sight threshold speed;

receiving grade measurements from a grade measuring device by the on-board controller and determining grade of rail;

determining worst-case braking distance of the rail vehicle using the rail vehicle speed and grade of rail;

receiving image data including a first signal aspect from a camera system and beacon/radio data including a second signal aspect from a beacon/radio system by the on-board controller;

determining if the first signal aspect matches the second signal aspect;

determining route of rail vehicle and speed limit of rail vehicle by the on-board controller based on the first signal aspect;

wherein when the rail vehicle speed is greater than a line-of-sight threshold speed, the on-board controller outputs a brake request; and wherein the image data includes signal identification and the on-board controller uses the signal identification to determine the position of the rail vehicle.

16. The method of claim 15, wherein the beacon/radio data includes signal identification and the on-board controller uses the signal identification to determine the position of the rail vehicle.

17. The method of claim 15, wherein the image data includes signal identification and the on-board controller uses the signal identification to determine the position of the rail vehicle and the beacon/radio data includes signal identification and the on-board controller uses the signal identification to determine the position of the rail vehicle.

18. The method of claim 15, wherein the on-board controller uses the image data to determine a first along-tracks distance to a signal and the beacon/radio data to determine a second along-tracks distance to a signal.

19. The method of claim 18, wherein when the first along-tracks distance to a signal does not match the second along-tracks distance to a signal, the computer output indicates an alarm.

20. The method of claim 15, wherein the on-board controller performs tests on the camera to confirm the camera's ability to identify shapes and colours.

* * * * *